United States Patent [19]

Svanström

[11] Patent Number: 4,798,123

[45] Date of Patent: Jan. 17, 1989

[54] MAGAZINES

[75] Inventor: Rune Svanström, Karlskoga, Sweden

[73] Assignee: Aktiebolaget Bofors, Bofors, Sweden

[21] Appl. No.: 37,304

[22] Filed: Apr. 10, 1987

[30] Foreign Application Priority Data

Apr. 10, 1986 [SE] Sweden ..... 8601605

[51] Int. Cl.[4] ..... F41D 10/22

[52] U.S. Cl. ..... 89/34; 89/33.14; 89/33.5

[58] Field of Search ..... 89/33.05, 33.1, 33.14, 89/33.16, 33.17, 33.5, 34; 198/572, 579, 460, 461

[56] References Cited

U.S. PATENT DOCUMENTS

| | | | |
|---|---|---|---|
| 2,951,422 | 9/1960 | Bobkowski | 89/33.1 |
| 3,101,647 | 8/1963 | Greene | 89/33.14 |
| 3,974,738 | 8/1976 | Meyer | 89/34 |
| 4,253,376 | 3/1981 | Washburn et al. | 89/33.14 |
| 4,344,350 | 8/1982 | Golden | 89/33.5 |

*Primary Examiner*—Stephen C. Bentley

*Attorney, Agent, or Firm*—Pollock, Vande Sande & Priddy

[57] ABSTRACT

A rapid-fire automatic gun is provided with a first magazine for a smaller number of rounds, and a second magazine for a greater number of rounds. The magazines include first and second round advancement members. The first of the round advancement members is controlled by the automatic gun itself, therefore round advancement speed, in the first magazine, is dependent upon the gun firing rate. The second round advancement members is driven by a driver which provides a maximum round advancement speed in the second magazine, for example 300 rounds per minute, considerably less than the maximum round advancement speed in the first magazine. When a difference in advancement speeds of the first and second magazines occurs, a transferring member for transferring rounds from the second to the first magazine provides gap formation in the row of rounds in the first magazine by successively filling them during and after firing.

9 Claims, 10 Drawing Sheets

MAGAZINES

BACKGROUND OF THE INVENTION

The present invention relates to a magazine apparatus which is intended for a rapid-fire automatic gun. The magazine apparatus includes a first magazine for a small number of rounds, for example from 15 to 20, and a second magazine for a large number of rounds, for example 200, the first magazine including first round feeding means and the second magazine including second round feeding means.

The present invention is intended to be employed for a rapid-fire automatic gun of, for example, 40 mm caliber. A large series of magazine arrangements for this type of weapon exists in this art. For instance, it is known in the gunnery art to provide double magazines on either side of the recoil jacket of the gun and to provide the magazine with advancement means for the rounds which are controlled by the gun such that round feed from the magazine is dependent upon the current firing rate of the weapon. It is also previously known to divide up each magazine in such a double magazine arrangement into a first and second submagazine.

It is further previously known in this art to advance the rounds in the magazine subsequently in rows and to employ stellar sprockets in the magazine which guide the rounds during the advancement process.

SUMMARY OF THE INVENTION

The novel magazine apparatus according to the present invention is to permit a very high rate of fire despite the size of the ammunition used, for example ammunition of a caliber of 40 mm or larger.

Moreover, the magazine apparatus must be able to store a relatively large number of rounds, when used as a single magazine approximately 200 or more, which in total would give approximately 400 rounds or more when used as a double magazine.

A further requirement placed on the magazine apparatus and its advancement means according to the present invention is that they be able to permit a burst of rounds of a length which corresponds to the number of rounds in the first magazine at full firing rate and, thereafter and without interruption in firing to be able to discharge all of the rounds held in the second magazine, but at reduced firing rate.

These above-outlined requirements imposed on the magazine apparatus according to the present invention would seemingly be incompatible. It is a serious problem to control accelerations and retardations in round advancement with the considerable mass which approximately 200 rounds represents. Operational disturbances arising out of cease-fire would be very difficult to obviate.

The object of the present invention is to provide a magazine apparatus which solves the above-disclosed and other structural problems.

In the present invention, that the first round advancement means in the first magazine are controlled by the automatic gun such that round advancement speed in the first magazine is effected dependent upon the firing rate of the automatic gun.

A second characteristic feature of the present invention is that the second round advancement means in the second magazine are positively drivable by a drive mechanism which attains a maximum round advancement speed in the second magazine which is less than the maximum round advancement speed in the first magazine.

A third characterizing feature of the present invention is that transfer means, the so-called packing members which transfer rounds from the second magazine to the first magazine, are arranged to provide gap formation in the row of rounds in the first magazine resulting from the difference in advancement speed between the first and second magazine.

A further development of the inventive concept as herein disclosed considers such matters as how large the differences in question between the round advancement speeds in the first and second magazines are to be. Thus, the maximum advancement speed in the first magazine may be approximately 400 rounds per minute or greater, while the maximum advancement speed in the second magazine is approximately 300 rounds per minute or lower. However, the present invention also operates for lower differences in the advancement speeds, but in order that the present invention be meaningful in its execution, the difference in speed should amount to approximately 500 rounds per minute or more.

The driving mechanism which drives the second round advancement means in the second magazine is preferably arranged to provide back-up replenishment of the first magazine during and after firing of the automatic gun which has occasioned a higher advancement speed in the first magazine that in the second magazine. To this end, use may be made of known counter-devices which sense the number of infed and discharged rounds to and from the first magazine, respectively.

The round advancement in the first magazine is preferably effected using hydraulically-powered advancement cogs. The transfer members (the packing members) which transfer the rounds from the second to the first magazine realize infeed into the first magazine by the successive ramming of rounds. This ramming operation is purely mechanical and entails that possible gaps in the row of rounds in the first magazine are filled by means of a force generated by the transfer members which, by the intermediary of the stellar sprockets, act upon forward-lying rounds.

The first magazine may include or consist of a fan-shaped magazine. In one embodiment of the present invention, the first magazine includes or is connected to a downfeed section located on the recoil jacket of the gun, this downfeed section being angled in relation to the fan-shaped magazine. A known round gripping device (tamper) is disposed at the bottom of the angled downfeed section. The round gripping device grasps a round which is advanced to a grasping position and transfers the round to the ramming section of the automatic gun (reciprocating tongue). The round gripping device senses the position of the round which is advanced to the above-mentioned gripping position. In that case when a gap has been advanced, a blocking device prevents the round gripping device from entering into function. The subsequent rounds in the row are continuously advanced until such time as a new round has been advanced to the gripping position.

In one preferred embodiment of the present invention, the first magazine encloses the rounds disposed in rows such that the distance between the first and the last round will always be substantially constant. In the utilization of a fan-shaped magazine, the above-mentioned transfer members will, on transfer of rounds from the second magazine to the first magazine, ensure that less movement is imparted to each respective round, viewed in the advancement member, at the forward regions of the round in relation to the movement imparted to the rear regions of the round. Correspondingly, a device which transfers rounds from the fan-shaped magazine to the above-mentioned angle (vertical) downfeed section which is connected to the recoil jacket of the gun, will ensure that greater movement is imparted to the forward end of each respective round than the movement imparted to the rear end of the round on transfer between the fan-shaped magazine and the downfeed section.

In one preferred embodiment of the present invention, use is further made of special advancement means in the fan-shaped magazine, in the form of three parallel rows of advancement cogs. In this arrangement, the advancement cogs of the middle row engage with each respective round at a point of engagement behind the center of gravity of the round, and the advancement cogs of the outer rows engage with each respective round equidistantly from the first-mentioned point of engagement. The advancement cogs of the middle row ensure for advancement of the rounds during the return motion of the advancement cogs of the outer rows, and vice versa.

The present invention also calls for a specific design of the transfer members (packing members) with chain-driven slip dollies mounted in rails which are pivoted in the advancement plane of the rounds embracing the longitudinal axes of the rounds. The outer rail is extended and its drive chain is driven at higher speed than the drive chain of the inner rail. The stellar sprockets in the first magazine are also of specific mutual arrangement. Similarly, the pair of stellar sprockets acting as transfer members between the fan-shaped magazine and the angled downfeed section is subject to specific arrangement and comprises, for example, five points as opposed to the remaining stellar sprockets which are provided with a lower number of points, for example 4.

The subject matter of the present invention affords a multiplicity of advantages. A large number of rounds can be stored in the magazine, at the same time as the firing rate may be rendered extremely high for the automatic gun as such. Moreover, long bursts of fire are permitted. When short rapid bursts are discharged, the magazine is back-up replenished during each burst and subsequent pause. Acceleration and retardation problems may be overcome by maintaining the advancement speed in the major (second) magazine at a reasonable level. Even though this is achieved at the cost of reduction in firing rate at the end of extremely long bursts of about 15 to about 25 rounds, this will in practice constitute a best solution, since the discharge of bursts of fire of such an extreme length are probably the exception rather than the rule.

The specifically designed and applied stellar sprockets in the preferred embodiment, like the alternately operating advancement cogs in the first magazine, provide a high degree of reliability against jamming of runs in the path of advancement. In the present invention it is advantageous that the second magazine may consist of a known and reliable magazine, for example a chain magazine.

Furthermore, the fan-shaped configuration of the first magazine permits, in a conventional manner, the reduction of the bulk of the piece of a minimum. The fan-shaped configuration of the magazine is a necessity, in that the rounds must be turned through 90° in their path of advancement.

BRIEF DESCRIPTION OF THE ACCOMPANYING DRAWINGS

The nature of the present invention and its aspects will be more readily understood from the following brief description of the accompanying drawings, and discussion, relating thereto, of one currently proposed embodiment of the magazine apparatus displaying the significance of the characteristics of the present invention.

Figure 5B:
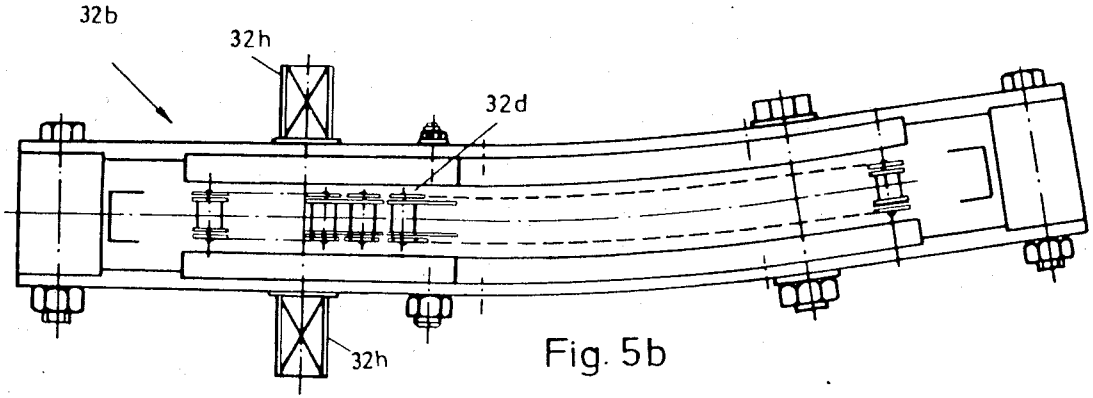
FIG. 5 is a side elevation showing inner transfer means (packers) for transferring rounds from the second magazine to the first magazine.
Figure 5A:
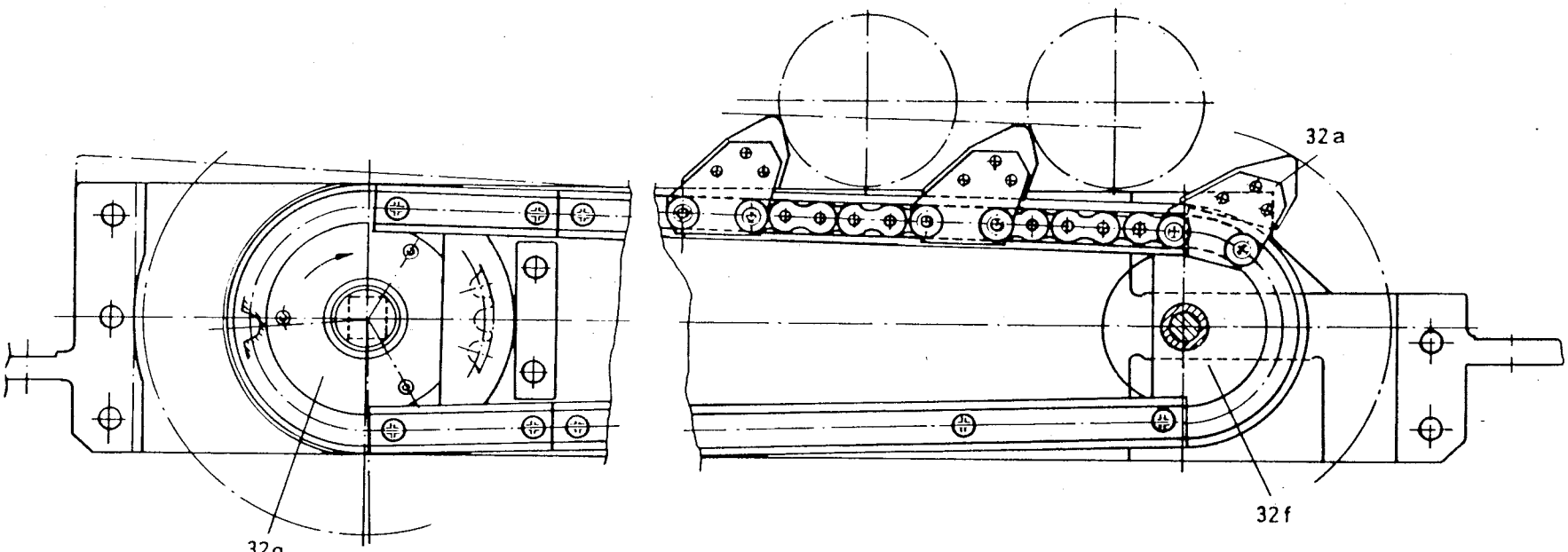
Figure 5:
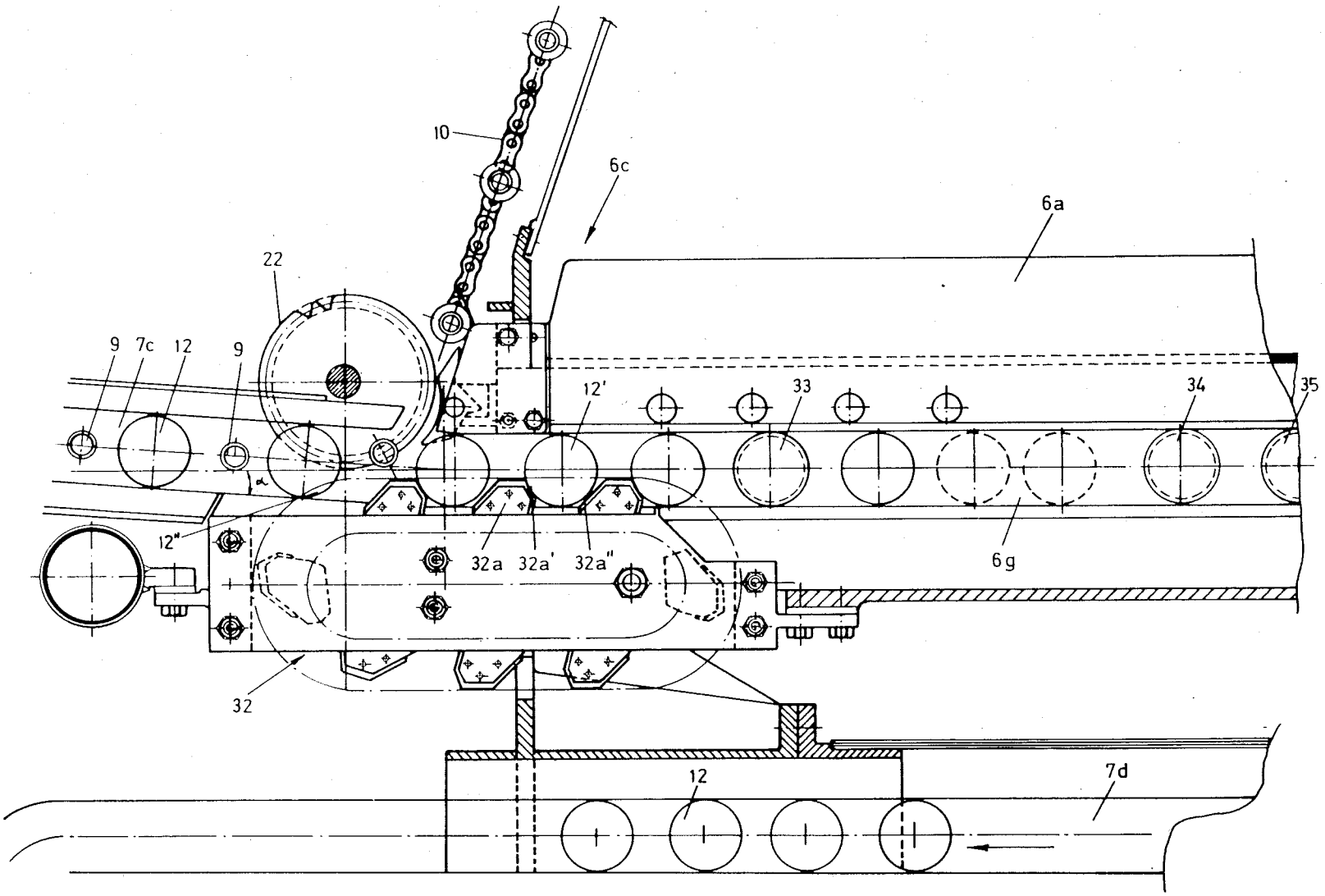
Figure 5C:
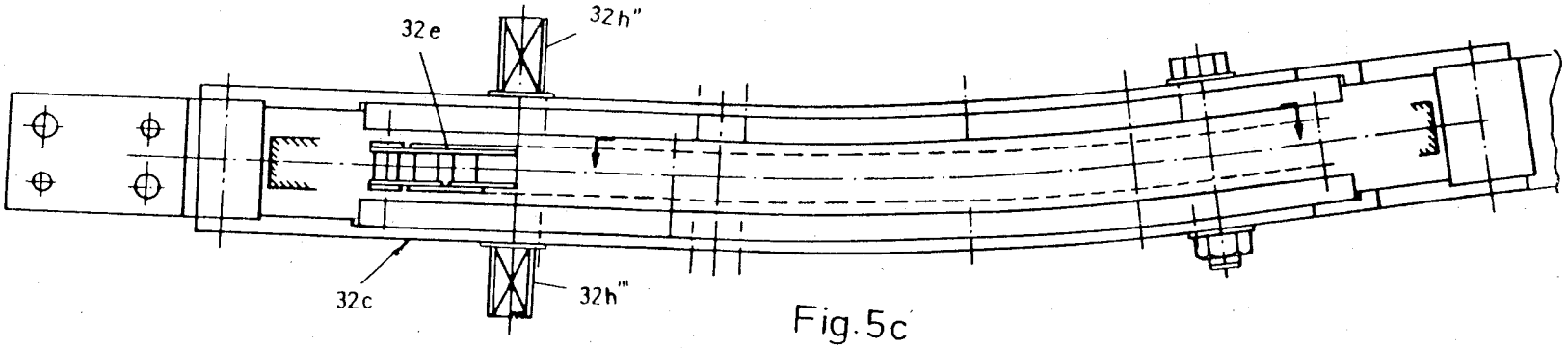
Figure 6:
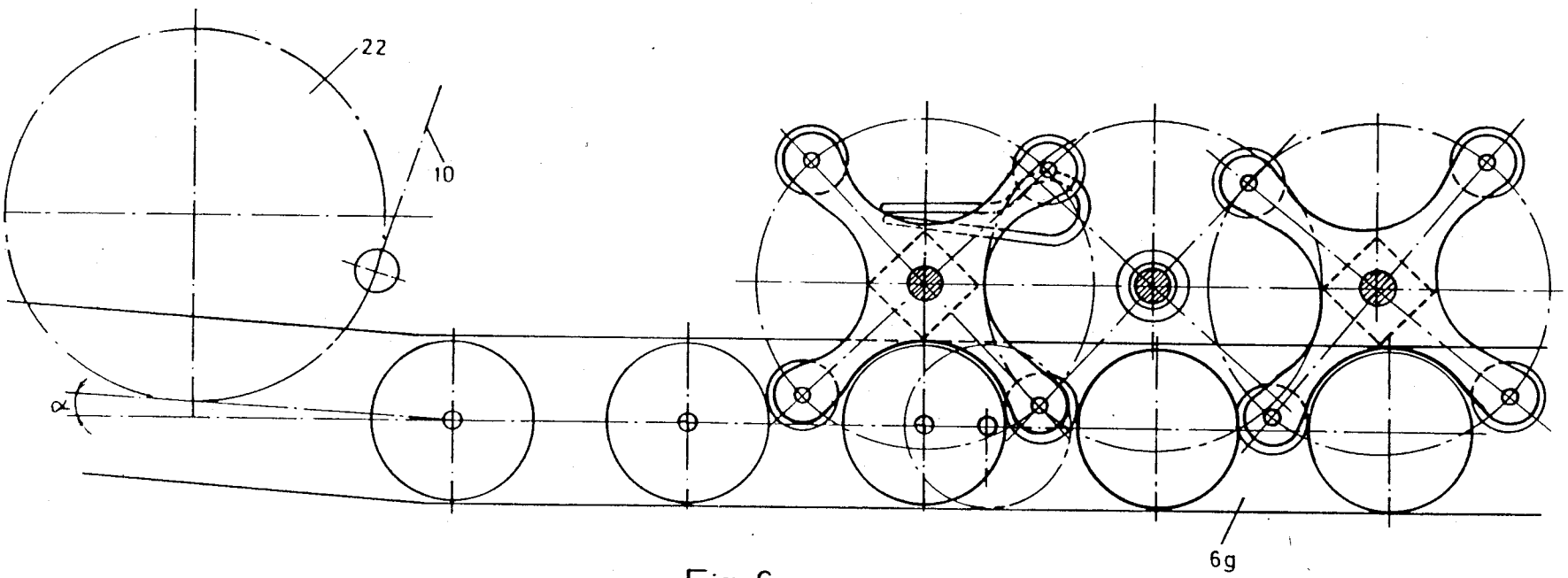
Figure 7:
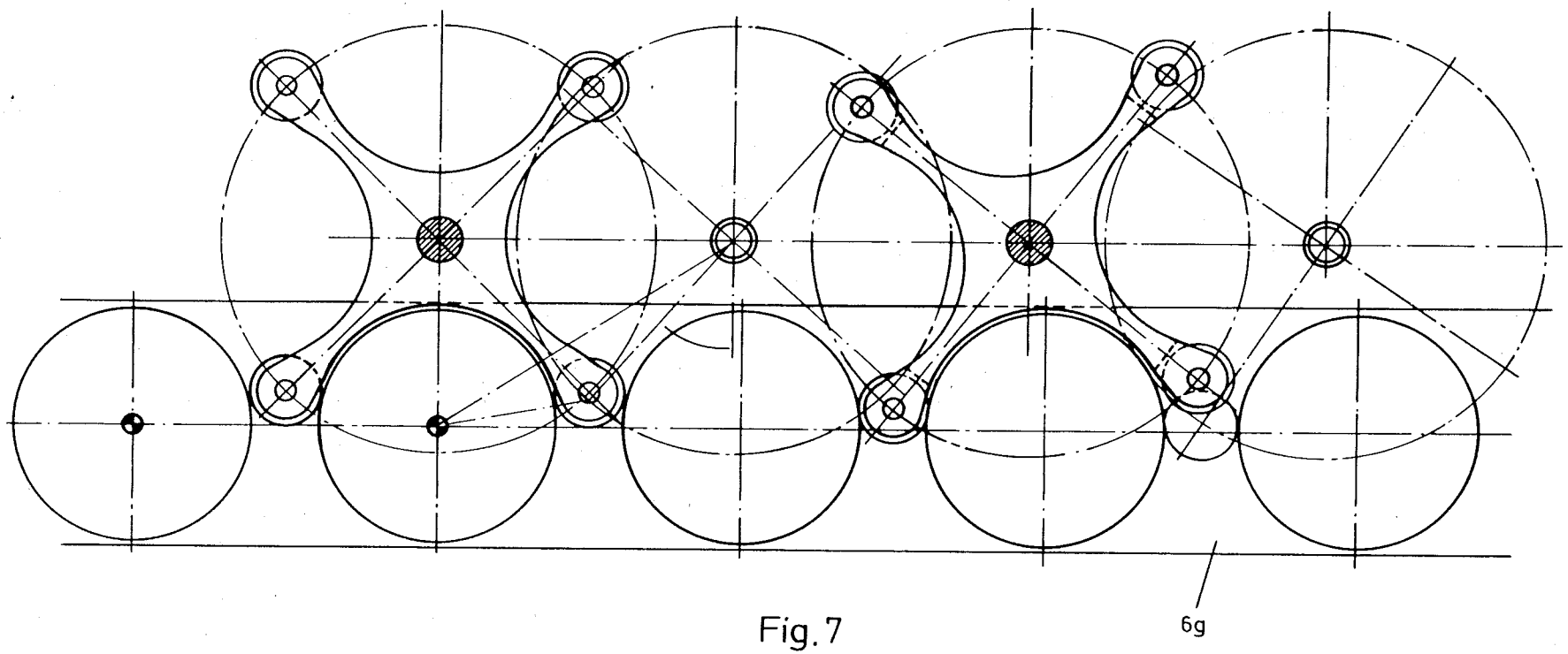
Figure 8:
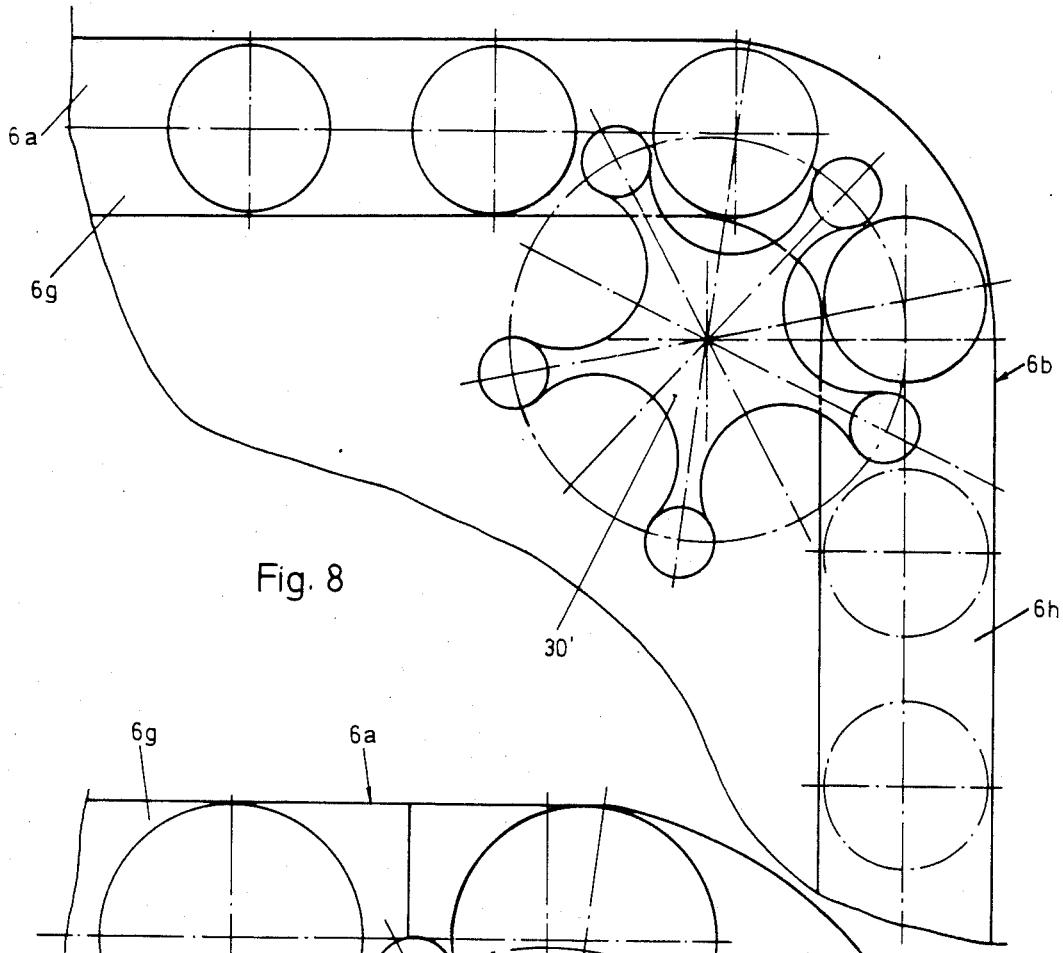
Figure 9:
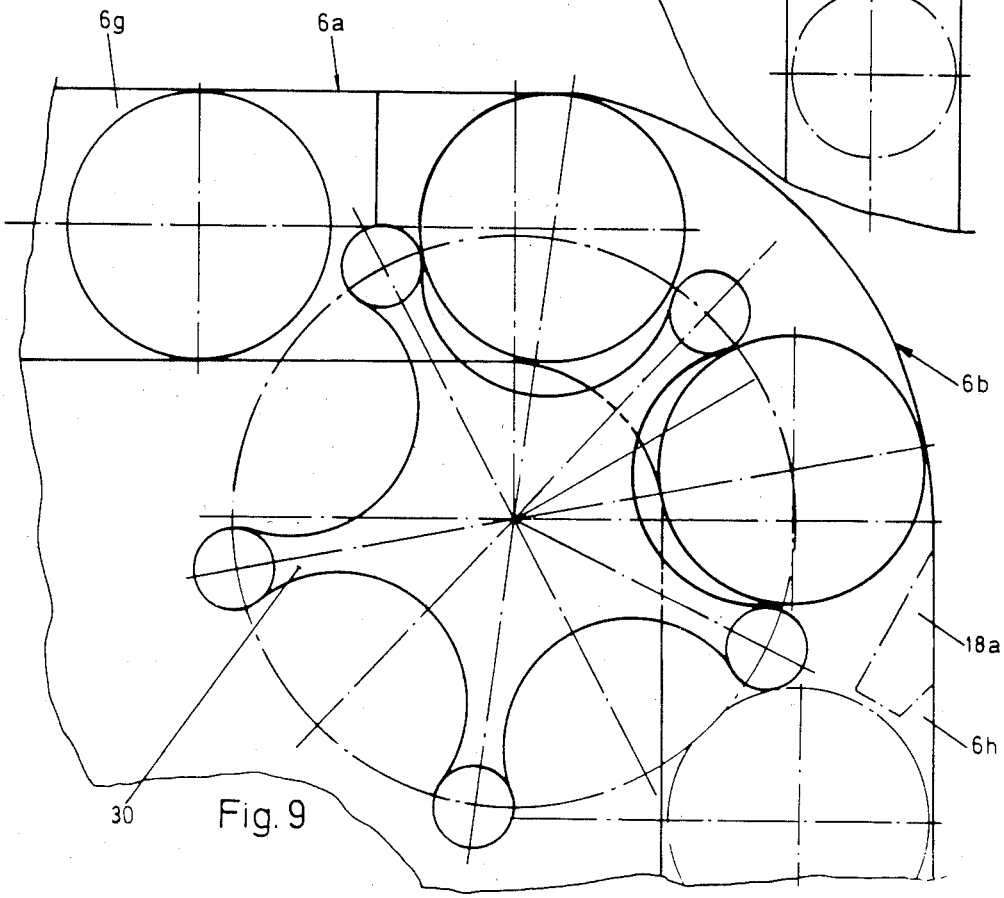
Figure 10:
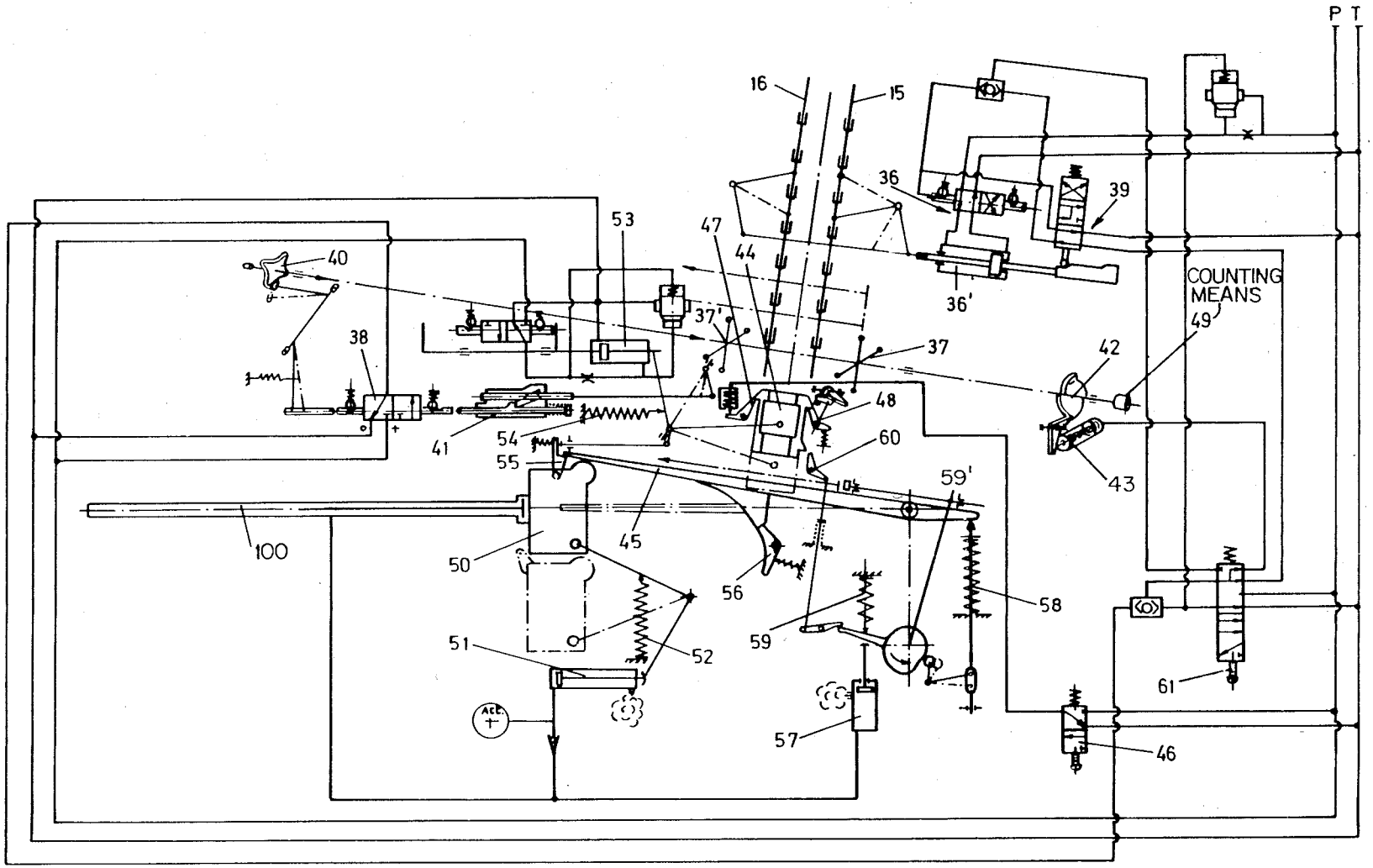

FIGS. 5*a*–5*c* are various views of details of the transfer member, the inner and outer packer;

FIG. 5*a* is turned through 180°;

FIG. 6 is a side elevation showing the first stellar sprockets in the fan-shaped magazine, these sprockets being located at the narrower portions of the round;

FIG. 7 is a side elevation of stellar sprockets placed on the same axes as the stellar sprockets of FIG. 6, but disposed at the thicker portions of the round;

FIG. 8 is a side elevation of members, in the form of stellar sprockets, for transferring rounds from the fan-shaped magazine to the vertical downfeed section at the narrower ends of the round;

FIG. 9 is a side elevation of the transfer member of FIG. 8 at the thicker portions of the shell; and FIG. 10 is a schematic diagram illustrating the function of the advancement means in the fan-shaped magazine and the vertical downfeed section.

DETAILED DESCRIPTION OF PREFERRED EMBODIMENT

Figure 1:
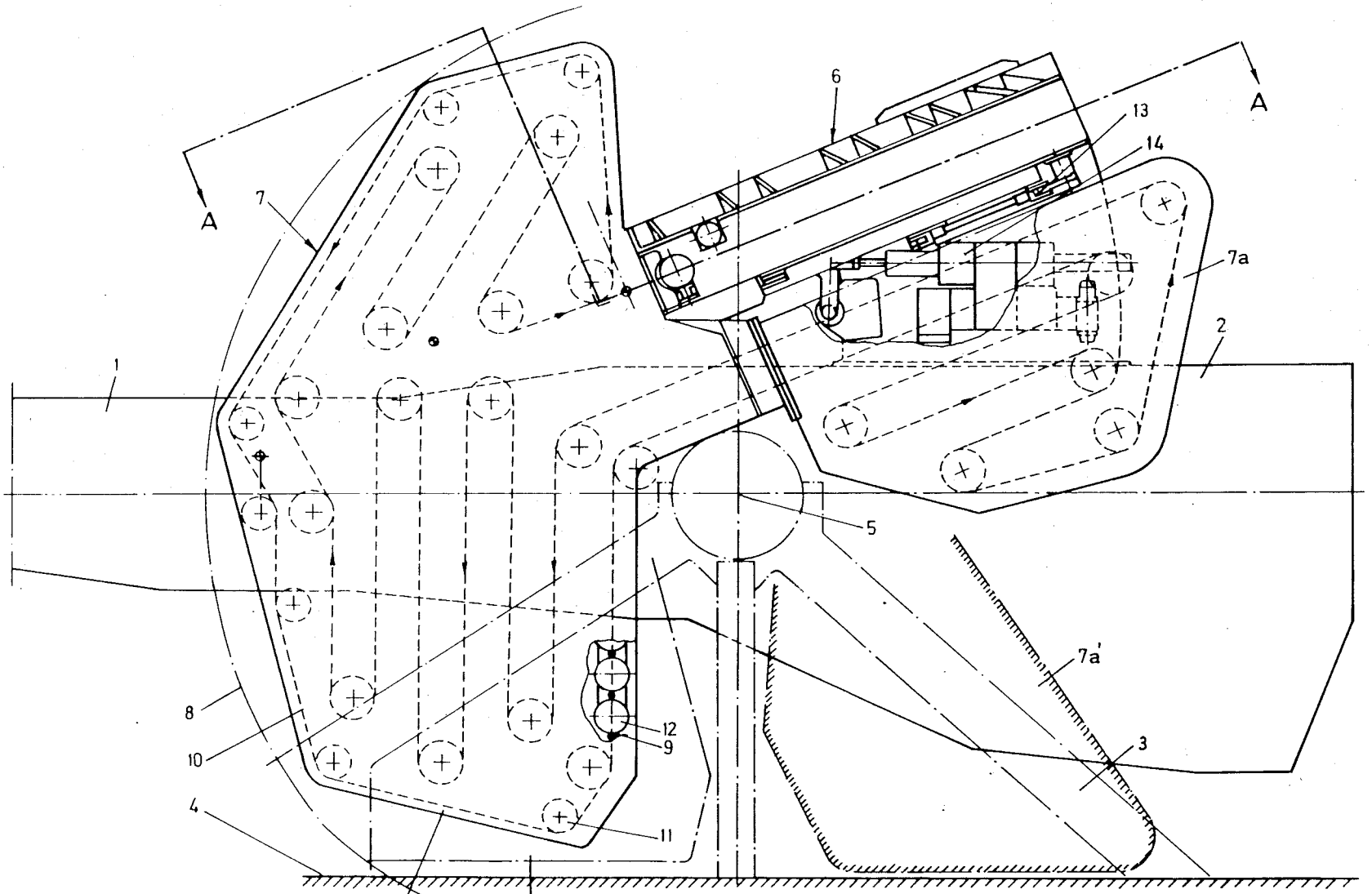
FIG. 1 is a side elevation illustrating parts of an automatic gun with its associated magazine apparatus according to the present invention.

Referring now to the drawings, FIG. 1 shows an automatic gun represented by its recoil jacket, whose forward end is designated 1 and whose rear end 2. The recoil jacket is conventionally mounted in a cradle 3 which is connected to a platform 4. The shaft bearing of the recoil jacket is designated 5 on the drawing.

The automatic gun displays double magazine apparatuses, one on either side of the recoil jacket 1, 2. In FIG. 1, only one magazine apparatus is shown. Each respective magazine apparatus includes a first magazine 6 and a second magazine 7. The second magazine 7 consists of a chain magazine which is of larger design making possible the storate of a large number of rounds, for example 200 rounds or more, which may be accommodated in the magazine without influencing the elevation and depression functions of the gun. A magazine 7*a* of the second magazine is shown in its end position 7*a*′ in conjunction with the upper face of the platform 4. Correspondingly, the critical position for a magazine part 7b on the second magazine is designated 7' on depression of the weapon. The magazine and adjacent weaponry are protected from the outer environment by a cupola with a movable embrasure sealing 8.

The second magazine 7 includes means for advancing the rounds laid in a long row or mutually subsequent path. These advancement means may consist of chains 10 on either side of each respective round and spacers 9 place ahead of and behind each respective round. The round path leads over a number of breast rolls, and one or more of these breast rolls may function as advancement means for the rounds 12.

One major characterizing feature of the present invention is that the first magazine 6 is driven by an external power source, this driving being controlled by the piece proper, while the second magazine 7 is driven separately in relation to the piece at a maximum predetermined rate which may be, for example, 300 rounds per minute. The advancement means in the first magazine 6 are positively influenced by the intermediary of a cylinder 14 and linkage mechanism 13.

Figure 2:
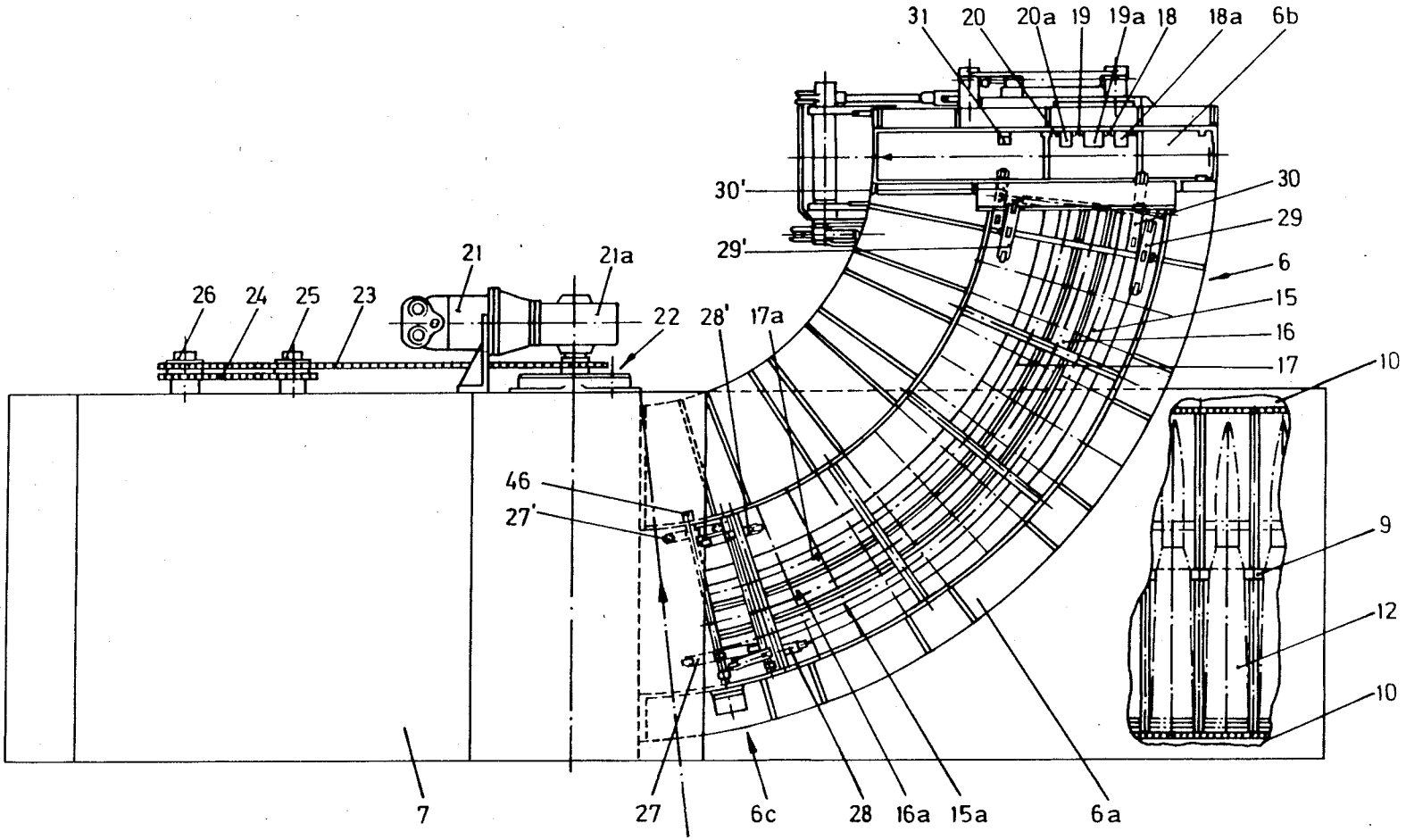
FIG. 2 is a horizontal view partly in section showing parts of the magazine apparatus of FIG. 1.

As the skilled reader will appreciate from FIG. 2, the first magazine 6 consists of a fan-shaped magazine 6a and a downfeed section 6b which is connected to the fan-shaped magazine 6a at its one end. At its other end, the fan-shaped magazine 6a is connected to the second magazine 7. The advancement means in the first magazine 6 consists of reciprocal paths with advancement cogs, in the present case 3 paths designated 15, 16 and 17. These paths display advancement cogs 15a, 16a and 17a, whose number in each respective path corresponds to the number of round to be accommodated in the fan-shaped magazine, for example between 15 and 20 rounds. Because of the extremely high advancement speed which may be attained in the first magazine, these advancement cogs operate alternatingly, such that the advancement cogs 16a of the central path execute their advancement movement during the return movement of the advancement cogs 15a and 17a in the outermost paths, and vice versa. The cogs nose the rounds in the advancement direction and the advancement cogs 16a of the central path engage each respective round at a point of engagement behind the center of gravity of the round and the advancement teeth 15a and 17a of the outermost paths in two points of engagement located equidistantly from the point of engagement of the advancement cogs of the central path. As a result of this arrangement, the rounds will not become obliquely displaced in their advancement movements towards the downfeed section 6b of the magazine. This section 6b is provided with corresponding reciprocal paths 18, 19 and 20 with corresponding downfeed cogs 18a, 19a and 20a. In this instance, these latter cogs operate in a manner corresponding to that of the advancement cogs 15a, 16a and 17a in the fan-shaped magazine 6a. The paths 15, 16, 17; and 18, 19, 20 are mechanically interconnected and are driven by the cylinder 14.

At its one end 6c, the fan-shaped magazine 6a is disposed to cooperate with a transfer member (not shown in detail in FIG. 2) which is operative to transfer rounds from the second magazine 7 to the first magazine 6. The transfer member, hereinafter designated as packing member, is driven by the intermediary of an adjustable hydraulic motor 21 which, through a gear 21a, drives a chain wheel 22 (to be described in greater detail below), and moreover at least two further drive wheels 25, 26 by the intermediary of chains 23 and 24. This packing member is arranged to urge in rounds into the fan-shaped magazine 6a by purely mechanical means. This urging force is effected on the outermost round and the force generated on ramming of this outermost round is propagated to the fan-shaped row of subsequent rounds by the intermediary of the stellar sprockets. In the fan-shaped magazine 6a, the rounds are guided by stellar sprocket pairs, of which two are illustrated at the end 6c of the magazine and are designated 27, 27'; and 28, 28', together with one pair at the end adjacent the downfeed section 6b, designated 29 and 29'. At this end, there is also provided a stellar sprocket pair 30, 30' serving as transfer means between the magazine 6a and 6b. The stellar sprockets 30 and 30' are 5-pointed, while the remaining stellar sprockets are 4-pointed. Because of the fan-shaped configuration, there will be realized a lesser degree of movement at the inner end of each respective round than at its outer end. One of the implications of this circumstance is that the outer stellar sprockets 27, 28 and so on in each respective stellar sprocket pair is larger than the inner stellar sprocket 27', 28', and so on. On the exit from the fan-shaped part to the downfeed section 6b, it is necessary that the stellar sprocket 30 be of a position in which its outermost parts project into the ammunition feed path of the downfeed section 6b. The downfeed part is also provided with a further guide 31. The stellar sprockets disposed in mutually subsequent relationship in the fan-shaped magazine with their axes pointing towards the floating zero of the fan are laterally offset in relation to one another in order that they are able to execute their respective rotational movements. As is apparent from the figure, the axes of the transfer stellar sprockets 30, 30' are also obliquely offset in relation to the chute surface of the magazine section 6b and with the axis pointing towards the floating zero of the fan configuration.

Figure 3:
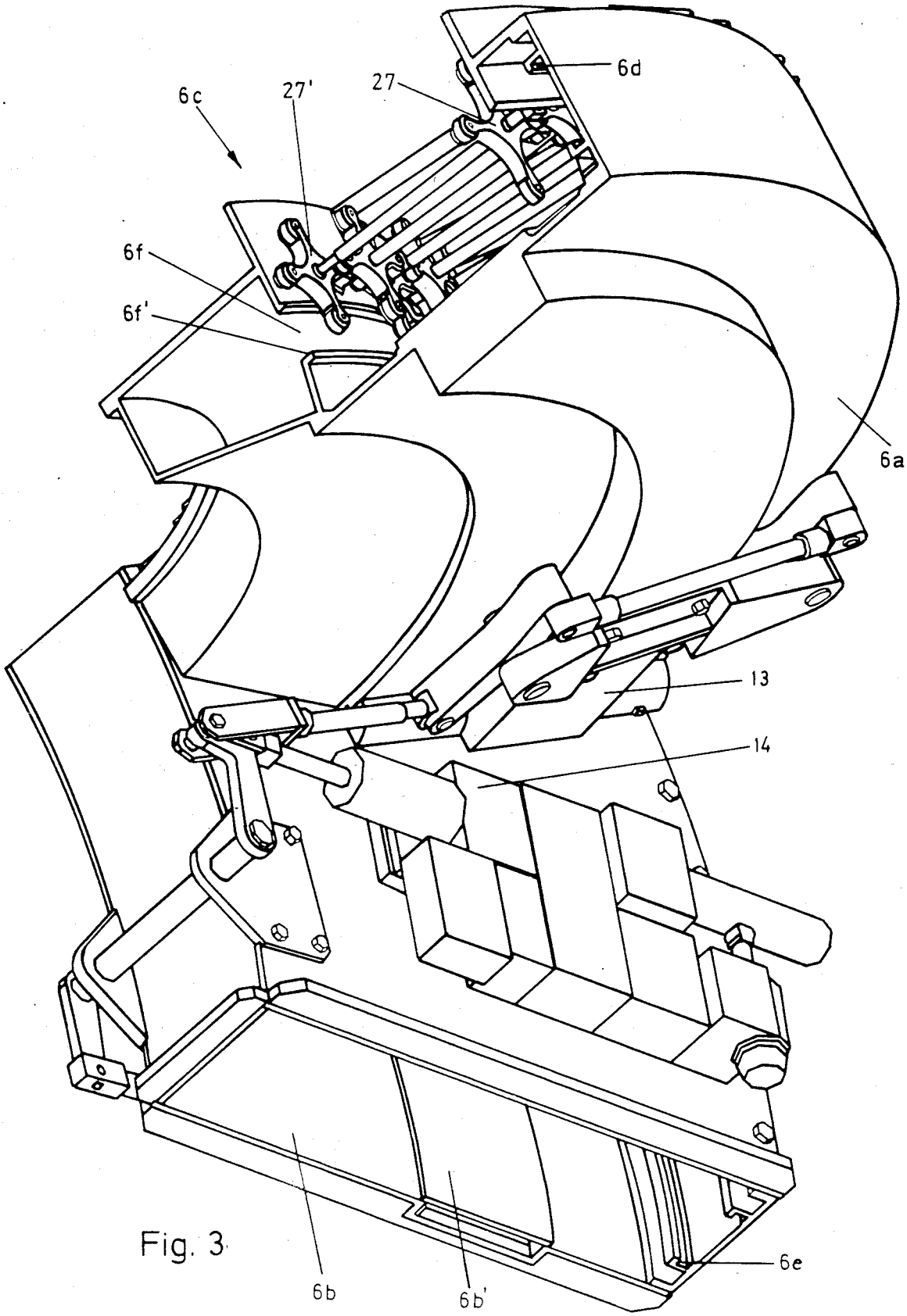
FIG. 3 is an oblique perspective view from beneath showing a more detailed embodiment of a first magazine included in the magazine apparatus and being in the form of a fan-shaped magazine with an associated vertical downfeed section which is connected to the fan-shaped magazine.

FIG. 3 is a detailed illustration of the fan-shaped magazine 6a and the vertical downfeed section 6b. In this latter section, illustrated at 6b' are body components for carrying the advancement paths with their associated, alternatingly operating advancement cogs. At the rear edge of the rounds, each respective magazine section 6a and 6b is provided with a guide flange 6d and 6e, respectively, for the flange of the cartridge case. The magazine section 6a is also provided with a longitudinal slot 6f and 6f' for support guiding of the projectile - or ogive section of the round.

Corresponding guide rails are provided in the downfeed section 6b.

The construction of the above-described magazine is essentially related to substantially conical or forwardly tapering rounds. Naturally, this magazine construction may be adapted to accommodate other types of rounds. As a result of the alternating reciprocal feed motion of the advancement cogs, rapid advancement speed may be achieved in the magazine.

Figure 4:
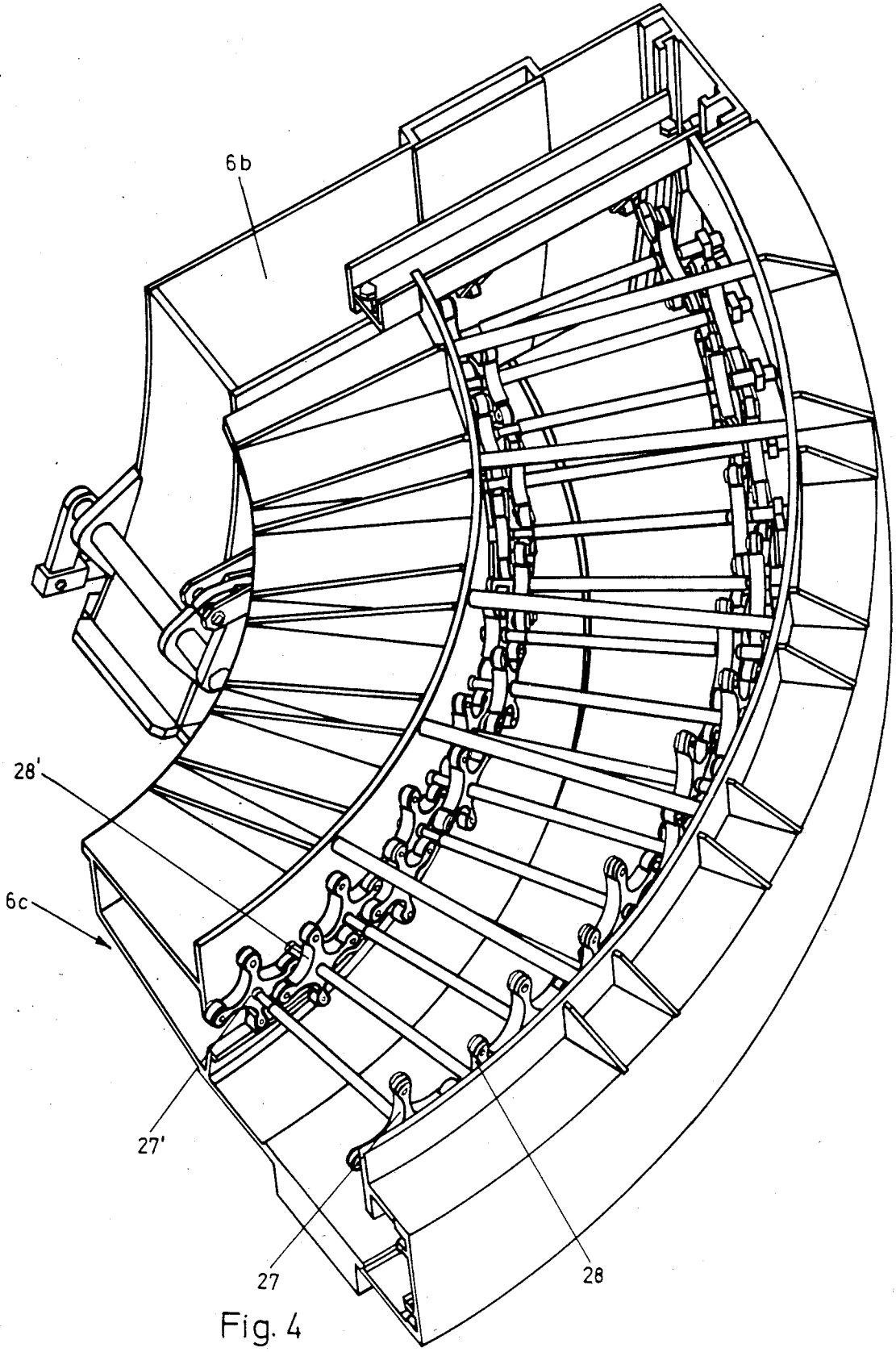
FIG. 4 is an oblique top perspective view of the fan-shaped magazine and the downfeed section of FIG. 3.

In FIG. 4, which shows the fan-shaped magazine obliquely from above, all of the stellar sprocket pairs included in the magazine are shown, in this example making up 15 in number. It will also be apparent to the skilled reader from this figure how adjacent stellar sprocket pairs are laterally offset in relation to one another for reasons of space. Each respective stellar sprocket displays, at each one of its points, a roll which permits low friction on contact of the stellar sprockets with the advanced rounds. The rolls are journalled each about their respective shaft with low friction bearing which first permits easy infeed of the rounds from the end 6c of the magazine by means of the packer, and secondly made for easy advancement function using the above-described advancement cogs. In their turn, the stellar sprocket shafts are journalled in bearings, for example spherical bearings in the body portion proper on the magazine 6a. The above-mentioned parts not shown in detail in FIGS. 3 and 4 constitute previously known construction components for assuring a robust and purposeful magazine construction. As a result of the mutual location of the stellar sprockets in the fan-shaped magazine, the distance between the two outermost rounds in the magazine will always be substantially uniform. Moreover, the illustrated stellar sprocket arrangement entails that a certain wave motion is propagated through the row of rounds on its advancement, for example the mutual spacing between the different rounds in the row varies slightly in dependence upon the degree of advancement of the row.

FIG. 5 illustrates the transfer member or packing member 32 which transfers rounds from the second magazine 7 to the first magazine which is represented by the fan-shaped portion 6a. The packing member 32 is also shown in FIGS. 5a, 5b and 5c which show different partial views and, in principle, consist of two mutually parallel rotary chains provided with dollies 32a for the rounds. Each respective dolly 32a cooperates with a round such that it may move one round, for example the round 12' to its front by cooperation with the round by the intermediary of an inclined advancement surface 32a', partly so as to restrain a subsequent round, for example the round 12', by the intermediary of an inclined rear surface 32a'. The packing member is driven by a hydraulic motor 21 through a system of gears. The rounds thus fed into the packing member are urged forward by the packing member and into the feed part 6g of the fan-shaped magazine. The packing member comprises two parallel rails 32b (FIG. 5b) and 32c (FIG. 5c) which each carry their respective chain 32d and 32e, on which the dollies 32e are secured. The rails are pivoted in the plane of the figure for FIGS. 5b and 5c. The outer rail 32c, like its chain 32e, is longer than the inner rail 32b and the inner chain 32d, respectively. The outer chain is driven at a higher speed than the inner chain, with the result that the rounds are advanced more quickly at their large caliber end than at their tip.

The advancement speed in the second magazine 7 accelerates following a pre-determined curve to a maximum speed of approx. 300 rounds per minute. The advancement feeding operation is commenced in that the fan-shaped magazine begins to feed rounds. If the discharge speed in the fan-shaped magazine exceeds the infeed speed in the second magazine, gaps will appear in the row of rounds in the fan-shaped magazine section 6a. In FIG. 5, three such gaps have been indicated by reference numerals 33, 34 and 35. The transfer member or packing member 32 is suspended in the body of the magazine and the discharge infeed channel 7c in the second magazine 7 connects to the infeed channel 6g at an angle (alpha) selected from a range of between about 2° and about 6°, preferably approximately 4°. Appropriately, the packing member may simultaneously cooperate with three rounds while awaiting reception of a fourth round (the round 12''). The obliquely inclined forward surfaces 32a' are, in such instance, of different inclinations and positions in the forward and rear chain for adaption of the movement of the rounds into conformity with the fan-shaped configuration of the magazine 6a. On the other hand, the rear actuating surfaces 32a'' on the dollies 32a may be of the same inclination at both of the chains.

As a result of the proposed structure of the magazine apparatus, it will be a simple matter to back-up replenish the first magazine if rate of discharge was higher in the maximum advancement rate of the second magazine and firing from the gun has thereafter ceased. In this situation, back-up replenishment is effected by allowing the advancement means in the second magazine 7 to continue to run until such time as all gaps in the first magazine 6 have been filled by the mechanical ramming operation from the packing member 32. Countermechanisms may advantageously be disposed at the input and output of the first magazine 6a, and these countermechanisms may subsequently control the back-up replenishment movement in the second magazine and also retard this movement.

FIGS. 6 and 7 are intended to illustrate the motional relationship of the stellar sprockets with respect to one another and to the rounds in the process of being advanced. Hence, FIG. 6 illustrates the stellar sprockets at the inner end of the rounds and FIG. 7 the stellar sprockets at the outer end of the rounds.

FIGS. 8 and 9 illustrate the transition between the first, fan-shaped magazine 6a and the downfeed sections 6b which leads to the ramming means of the automatic gun. Here, the stellar sprocket pair 30, 30' serves as transfer means between the magazine parts in question. The channels for advancement of the rounds are indicated by 6b and 6h, respectively.

As will have been apparent to the skilled reader of the foregoing, the advancement means in both of the first magazine sections 6a and 6b are coordinated and controlled by the firing rate of the gun. FIG. 10 shows how the hydraulic valve 36, cooperating with a working cylinder 36', realizes alternating advancement movements in two parallel paths, for example the advancement paths 15 and 16 in FIG. 2. In this figure, turnstiles 37, 37' are indicated for arresting the motion of the rounds in a position above the tamping position. A valve 38 is provided to realize, by the intermediary of the hydraulic valve 36, activation and deactivation of the working cylinder 36', respectively. The valve 38 also controls a locking device 39 which locks the hydraulic valve 36 at its end position. The valve 38 may be switched by a mechanical operating device 40 in the form of a cam which senses the rotation of the locking wheels 37, 37'; and by a device 41 which senses the position of the tamper. The rotational axis of the locking wheels 37, 37' is blocked by a spur gear 42 which may be released by the hydraulic valve by the intermediary of further locking means 43.

FIG. 10 also schematically illustrates a tamper 44 which, in a predetermined advancement position for each respective round, grasps the round and transfers it to a ramming bay (reciprocating tongue) 45 or corresponding device in the automatic gun. These latter functions are well known to those conversant in the gunnery art and will not be described in greater detail here. The circuit further includes a firing device 46 on whose activation a lock 47 is jerked away from the tamper. A further block 48 is provided for the tamper. This block is controlled by the weight or the mass of the round advanced into the gripping position. If a gap as described in the foregoing has been advanced to the gripping position, the locking device in question is not triggered, with the result that the tamper remains in its position as illustrated in the drawing figure. Renewed advancement is thereafter initiated and if a new gap arrives at the previously-mentioned grasping position, the result will be the same. As soon as a new round has been advanced to the grasping position, the blocking device 48 is also triggered and the tamper may grasp the round advanced to the grasping position and transfer it to the reciprocating tongue 45. The counting mechanism 49 senses the number of infed and discharged rounds in the fan-shaped magazine 6a. The counting pulses are entered in comparison means which, in their turn control the advancement means (the hydraulic motor 21) in the second magazine.

In FIG. 10, the barrel 100 of the gun has been indicated, like the breech mechanism 50 of the gun which is shown in the closed and opened positions. A gas-activated piston 51 ensure opening of the breech, and a spring 52 for the breech closure. Furthermore, a cylinder 53 is shown for lifting the tamper, a tamper spring 54, a catch lock 55 and a lock 56 for dropping the reciprocating tongue. A gas-activation piston 57 is provided for placing the spring 58 of the reciprocating tongue and a ramming spring 59 under tension. The ramming spring 59 is coupled, by the intermediary of a linkage system 59', to a catch lock 60 which is shown in the position when the rammer is placed under tension. A gun-unload button has been marked 61.

These latter components relating to the breech mechanism of the gun and its ramming section are known in this art and will not, therefore, be described in detail here.

The present invention should not be considered as restricted to the embodiment described above and shown on the drawings by way of example, many modifications being conceivable without departing from the spirit and scope of the appended claims.

What we claim and desire to secure by Letters Patent is:

1. In a rapid-fire automatic gun a magazine apparatus comprising:

a first magazine for a substantially small number of rounds;

a second magazine for a substantially large number of rounds;

a first round advancement means for advancing said rounds in said first magazine, said first means being controlled by the automatic gun such that the round advancement speed in said first magazine is dependent upon rate of fire of the automatic gun;

a second round advancement means for advancing rounds in said second magazine;

a driving means for driving said second round advancement means at a maximum speed smaller than the maximum round advancement speed in said first magazine;

a transfer means for transferring rounds from said second magazine to said first magazine, said transfer means being adapted to provide formation of a gap in the row of rounds being advanced in said first magazine when a difference occurs in the advancement speeds in said first and second magazines, said transfer means including a packing member having a plurality of inclined surfaces for cooperation with respective rounds, a round grasping means located adjacent the breech of the automatic gun for grasping each respective round from a predetermined advancement position and transferring said round to a ramming bay; and a disabling means for disabling said round grasping means during advancement of said gap in the row of round in said first magazine.

2. Apparatus as claimed in claim 1, wherein said maximum advancement speed in said first magazine is from about 400 rounds per minute; and said maximum advancement speed in said second magazine is up to about 300 rounds per minute.

3. Apparatus as claimed in claim 1 wherein said round advancement speed in said second magazine is the same as said round advancement speed in said first magazine up to a predetermined value of the said round advancement speed, in said first magazine.

4. Apparatus as claimed in claim 1, wherein said driving means for driving said second round advancement means in said second magazine provide a back-up replenishment of said first magazine during and after firing which causes higher round advancement speed in said first magazine than in said second magazine; and wherein said back-up replenishment is determined by sensing means for sensing the number of rounds being fed into and discharged from said first magazine.

5. Apparatus as claimed in claim 4, wherein said round advancement means in said first magazine includes hydraulically driven advancement cogs controlled by firing rate of the gun; wherein said transfer member for transferring rounds from said second to said first magazine feeds the rounds into said first magazine by means of successive ramming of rounds which are urged forwardly by stellar sprockets; and wherein said gaps in the row of rounds in said first magazine are filled by the impression urging of rounds executed by said transfer member.

6. Apparatus as claimed in claim 5, wherein said first magazine includes a fan-shaped magazine, said fan-shaped magazine connecting to said transfer means at one end and, at the other end to a down-feed section located behind said gun, said downfeed section being angled in relation to said fan-shaped magazine.

7. Apparatus as claimed in claim 6, wherein said first magazine encloses the rounds placed in a row, such that the distance between the first round and the last round is always substantially constant; wherein said transfer means transferring rounds from said second magazine to said first magazine, imparts to each respective round, seen in the feeding plane, higher speed at the rear end of said round than at the forward end of said round; and wherein means transferring rounds from said fan-shaped magazine to said angled downfeed section connected to the recoil jacket of said gun impart to the forward end of each respective round an additional speed on the transfer between said fan-shaped magazine and said advancement section.

8. Apparatus as claimed in claim 7, wherein said advancement means in said first magazine includes vertically reciprocal advancement cogs, said cogs forming three parallel rows, in which advancement cogs of a central row engage with each respective round behind the point of gravity thereof, and advancement cogs of outer rows engage with each respective round equidistantly from the point of gravity thereof, said advancement cogs of said central row ensuring the advancement of rounds during a return motion of the advancement cogs of said outer rows, and vice versa.

9. Apparatus as claimed in claim 8, wherein said stellar sprockets are 4-pointed with one pair of stellar sprockets located adjacent to said downfeed section, which comprise 5-pointed stellar sprockets.

* * * * *